US012188388B1

(12) United States Patent
Schumann

(10) Patent No.: US 12,188,388 B1
(45) Date of Patent: Jan. 7, 2025

(54) OIL HEAT EXCHANGER

(71) Applicant: Laverne Schumann, Blue Grass, IA (US)

(72) Inventor: Laverne Schumann, Blue Grass, IA (US)

( * ) Notice: Subject to any disclaimer, the term of this patent is extended or adjusted under 35 U.S.C. 154(b) by 0 days.

(21) Appl. No.: 17/991,488

(22) Filed: Nov. 21, 2022

Related U.S. Application Data

(60) Provisional application No. 63/281,718, filed on Nov. 21, 2021.

(51) Int. Cl.
*F01M 5/00* (2006.01)
*F01M 11/00* (2006.01)

(52) U.S. Cl.
CPC ..... *F01M 5/002* (2013.01); *F01M 5/001* (2013.01); *F01M 2011/0025* (2013.01)

(58) Field of Classification Search
CPC . F01M 5/002; F01M 5/001; F01M 2011/0025
See application file for complete search history.

(56) References Cited

U.S. PATENT DOCUMENTS 1,511,250 A * 10/1924 Wright ..... F01M 5/001 184/104.1
1,761,942 A * 6/1930 Strickland ..... F01M 5/002 184/104.1
1,989,585 A * 1/1935 Bigelow ..... F01M 5/007 184/104.1
2,063,782 A * 12/1936 Barnes ..... F01M 5/002 123/196 AB
2,487,215 A * 11/1949 Blatt ..... F01P 11/08 184/104.3
3,830,289 A * 8/1974 Olson ..... F01M 11/03 165/119
4,397,269 A * 8/1983 Hatz ..... F01P 9/00 123/196 AB
4,898,261 A * 2/1990 Winberg ..... F01M 11/0004 123/196 AB
5,408,965 A * 4/1995 Fulton ..... F01M 11/0004 123/196 AB
6,217,758 B1 * 4/2001 Lee ..... F01M 11/0004 210/186
6,871,628 B1 * 3/2005 Tauer ..... F01M 5/002 165/44
2004/0177827 A1 * 9/2004 Hoyte ..... F01M 11/0004 123/196 AB
2008/0257625 A1 * 10/2008 Stranges ..... F16H 57/0412 180/69.1
2010/0147254 A1 * 6/2010 England ..... F01M 11/0004 123/196 AB
2017/0051821 A1 * 2/2017 Long ..... F16H 57/0452

* cited by examiner

*Primary Examiner* — Michael A Riegelman
(74) *Attorney, Agent, or Firm* — Simmons Perrine Moyer Bergman PLC

(57) ABSTRACT

One embodiment of an oil heat exchanger may be configured with two fluid couplers fluidly connected to a fluid conduit. The fluid conduit may be engaged with an exchange area. In one illustrative method of use the oil heat exchanger may be positioned within and secured to an oil pan of an internal combustion engine.

8 Claims, 4 Drawing Sheets

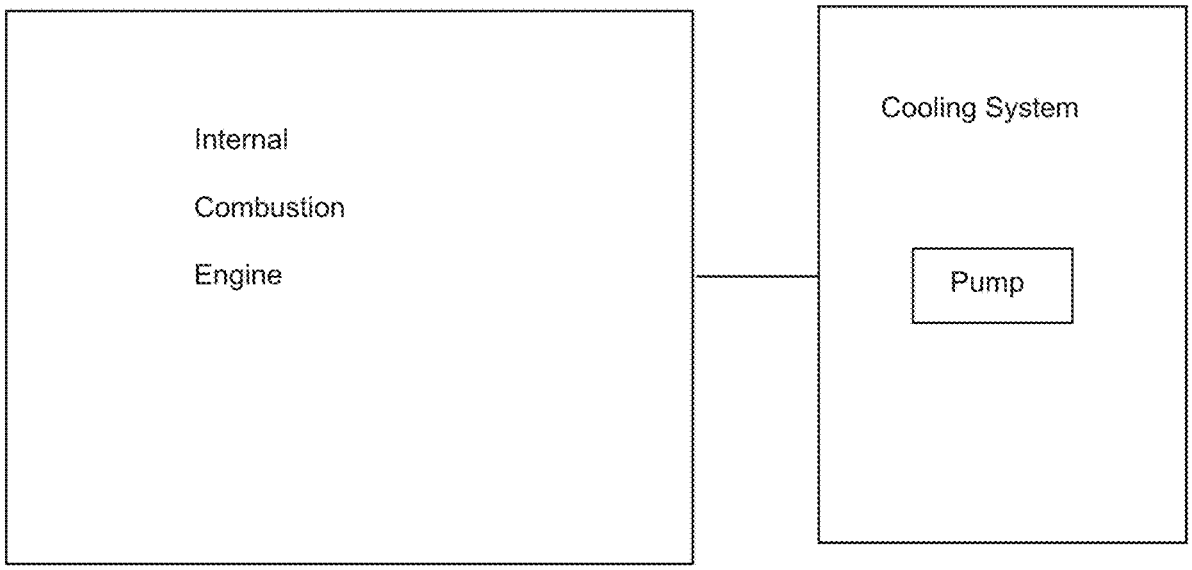
FIG. 4 - PRIOR ART

OIL HEAT EXCHANGER

CROSS REFERENCE TO RELATED APPLICATIONS

Applicant claims the filing benefit of provisional U.S. Pat. App. No. 63/281,718 filed on Nov. 21, 2021, which is incorporated by reference herein in its entirety.

FIELD OF INVENTION

This invention relates generally to heat exchanges, and more specifically in an illustrative embodiment to a heat exchanger that may be used within an oil pan of an internal combustion engine.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND

Many internal combustion engines have an optimal temperature range for engine oil. When the temperature is lower than the optimal range, such as during a cold start, excess wear and/or stress may be placed on the engine and/or other internal components. Accordingly, it may be desirable to heat the engine oil prior to starting the engine and/or other equipment to reduce engine oil viscosity and/or provide other advantages and/or desirable conditions. In other applications, certain engines may produce maximum power when all engine components are cool and/or at ambident temperature, but the engine oil is at operating temperature (which temperature is typically higher than ambient temperature).

In other applications it may be desirable to remove thermal energy from engine oil, such as in road racing and/or circuit racing. In the prior art, such thermal energy transfer from the engine oil is typically accomplished with a discreet engine oil cooling system, which generally require dedicating piping, oil coolers (e.g., specific radiators dedicated to engine oil cooling), control systems, other fluid handling components, and/or other equipment, all of which add complexity and weight among other disadvantages without limitation unless otherwise indicated.

BRIEF DESCRIPTION OF THE FIGURES

The accompanying drawings, which are incorporated in and constitute a part of this specification, illustrate embodiments and together with the description, serve to explain the principles of the methods and systems described herein. These drawings depict only typical embodiments and are not therefore to be considered limiting to the scope of the present disclosure unless otherwise indicated in the following claims.

FIG. 4 is a representation of a portion of the prior art of the present invention.

DETAILED DESCRIPTION - LISTING OF ELEMENTS

Figure 1:
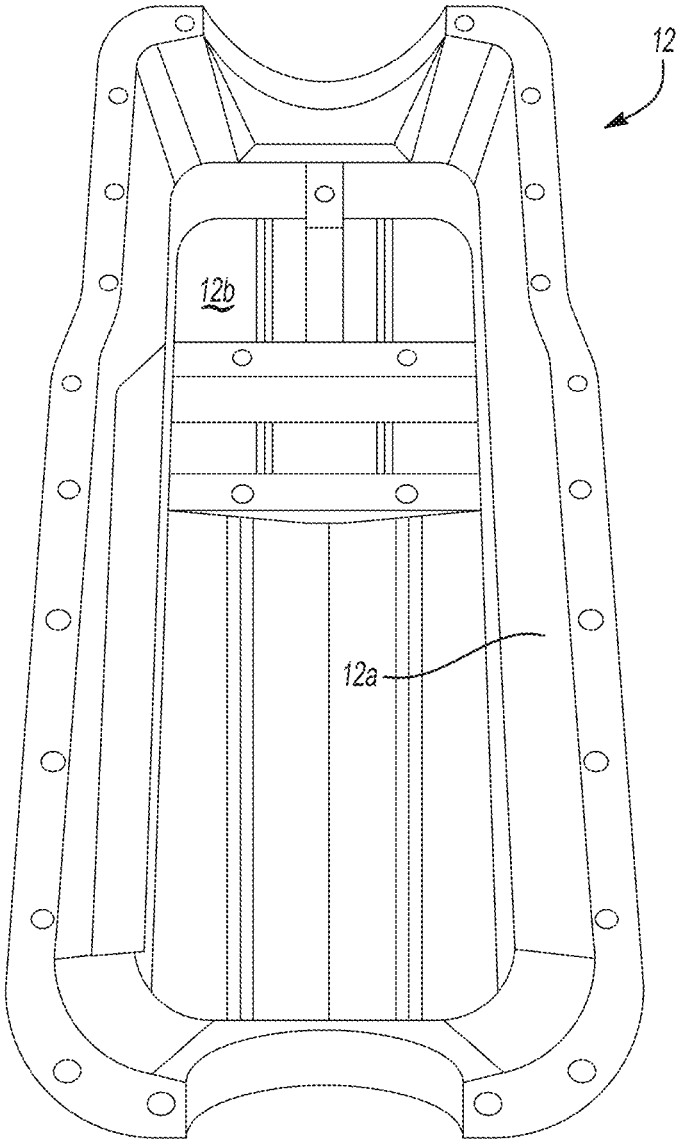
FIG. 1 provides a perspective view of one embodiment of an oil pan with which various illustrative embodiments of an oil heat exchanger may be used.

| ELEMENT DESCRIPTION | ELEMENT NUMBER |
|---|---|
| Heat Exchanger | 10 |
| Oil pan | 12 |
| Pan wall | 12a |
| Pan floor | 12b |
| Body | 20 |
| First fluid coupler | 22 |
| Fluid conduit | 23 |
| Second fluid coupler | 24 |
| Exchange area | 26 |
| Mounting tab | 28 |

DETAILED DESCRIPTION

Before the present methods and apparatuses are disclosed and described, it is to be understood that the methods and apparatuses are not limited to specific methods, specific components, or to particular implementations. It is also to be understood that the terminology used herein is for the purpose of describing particular embodiments/aspects only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

"Aspect" when referring to a method, apparatus, and/or component thereof does not mean that limitation, functionality, component etc. referred to as an aspect is required, but rather that it is one part of a particular illustrative disclosure and not limiting to the scope of the method, apparatus, and/or component thereof unless so indicated in the following claims.

Throughout the description and claims of this specification, the word "comprise" and variations of the word, such as "comprising" and "comprises," means "including but not limited to," and is not intended to exclude, for example, other components, integers or steps. "Exemplary" means "an example of and is not intended to convey an indication of a preferred or ideal embodiment. "Such as" is not used in a restrictive sense, but for explanatory purposes.

Disclosed are components that can be used to perform the disclosed methods and apparatuses. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and apparatuses. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and apparatuses may be understood more readily by reference to the following detailed description of preferred aspects and the examples included therein and to the Figures and their previous and following description. Corresponding terms may be used interchangeably when referring to generalities of configuration and/or corresponding components, aspects, features, functionality, methods and/or materials of construction, etc. those terms.

It is to be understood that the disclosure is not limited in its application to the details of construction and the arrangements of components set forth in the following description or illustrated in the drawings. The present disclosure is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description, and do not alone indicate or imply that the device or element referred to must have a particular orientation. In addition, terms such as "first", "second", and "third" are used herein and in the appended claims for purposes of description and are not intended to indicate or imply relative importance or significance.

Figure 2:
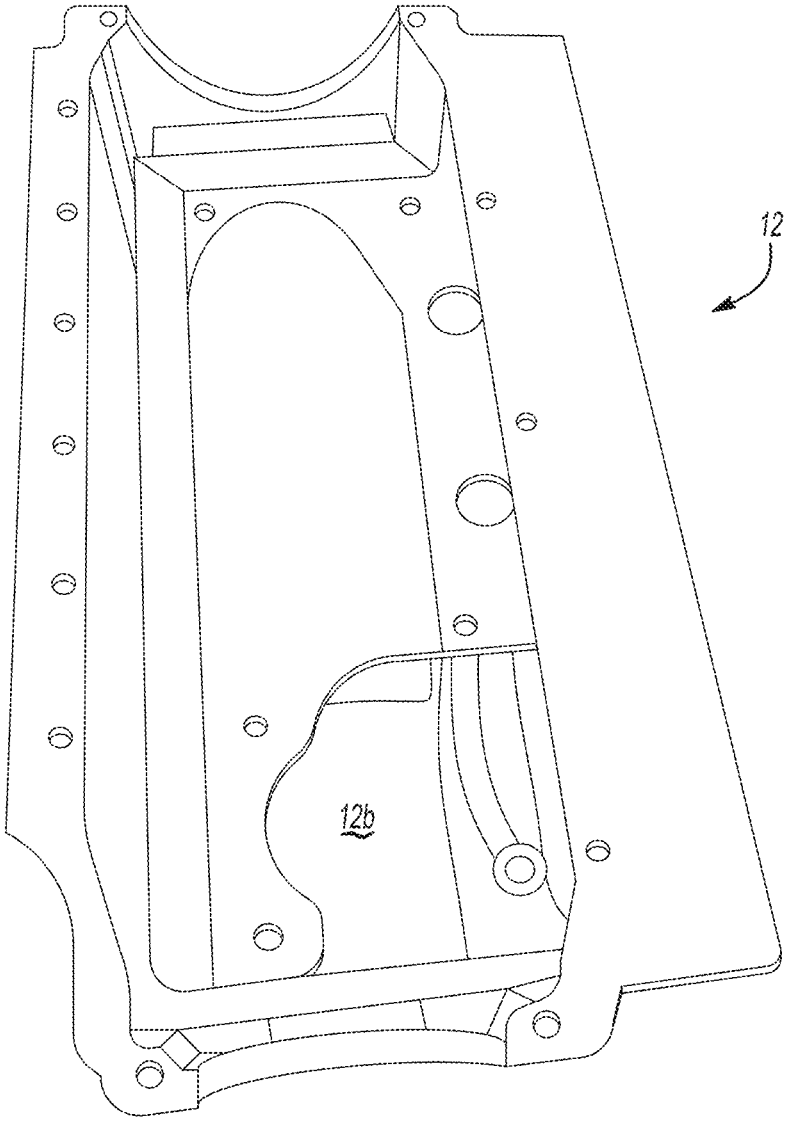
FIG. 2 provides a perspective view of a second embodiment of an oil pan with which various illustrative embodiments of an oil heat exchanger may be used.

Referring now to the drawings, wherein like reference numerals designate identical or corresponding parts throughout the several views, FIG. 1 provides an elevated perspective view of one embodiment of an oil pan 12 with which various illustrative embodiments of an oil heat exchanger 10 may be used, and FIG. 2 provides such a view of a second embodiment of such an oil pan 12. Each oil pan 12 may be configured with a pan floor 12*b*, which may have various contours, shapes, and/or configurations, and one or more pan walls 12*a* extending upward from the pan floor 12*b*. The distal end of the pan wall 12*a* may be configured to provide an interface with a portion of an engine and may be configured to form a hermetic seal therebetween. The interior of the two oil pans 12 is shown in FIGS. 1 & 2, and it is contemplated that for most applications the oil heat exchanger 10 may be positioned within an oil pan 12 without limitation unless otherwise indicated in the following claims. Although the specific illustrative embodiments of an oil heat exchanger 10 as shown and described herein may be especially useful for positioning in the interior portion of an oil pan 12 of an internal combustion engine, the scope of the present disclosure is not so limited and extends to any application of the oil heat exchanger 10 unless otherwise indicated in the following claims.

Figure 3:
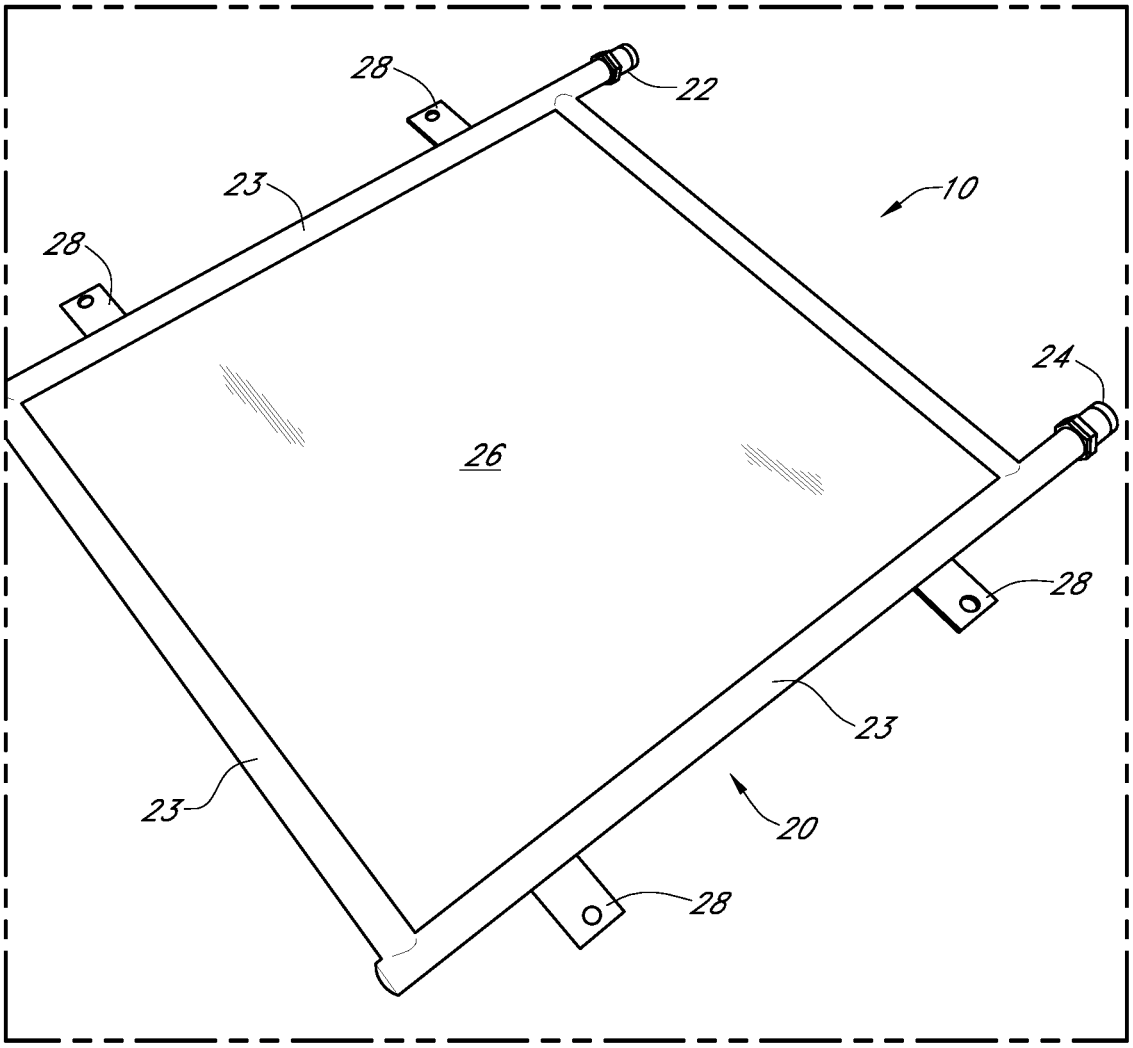
FIG. 3 provides a perspective view of a first illustrative embodiment of an oil heat exchanger.

Referring now to FIG. 3, which provides a perspective view of a first illustrative embodiment of an oil heat exchanger 10, the oil heat exchanger 10 may be formed with a body 20 comprised of an exchange area 26 and one or more fluid conduits 23. The fluid conduit 23 may be in fluid communication with and fluidly connected to both a first fluid coupler 22 and a second fluid coupler 24. Accordingly, a heat transfer fluid may be introduced to the oil heat exchanger 10 via one of the fluid couplers 22, 24 serving as an inlet, travel through the fluid conduit 23, and exit via the other fluid coupler 22, 24, which fluid coupler 22, 24 may serve as an outlet for the heat transfer fluid.

One or more mounting tabs 28 may be positioned on the body 20. It is contemplated that the mounting tabs 28 may provide one or more attachment points for the oil heat exchanger 10 to secure its proper position during use without limitation unless otherwise indicated in the following claims.

FIG. 4 is a representation of a portion of the prior art of the present invention.

In one illustrative method of use, and without limitation unless otherwise indicated in the following claims, the oil heat exchanger 10 may be positioned within an oil pan 12 such that during expected operating conditions all or a portion of the body 20 may be in direct contact with oil positioned within the oil pan 12. The mounting tabs 28 may be configured such that they provide one or more attachment points for the oil heat exchanger 10 to secure its proper position within and relative to the oil pan 12 during use without limitation unless otherwise indicated in the following claims.

The fluid couplers 22, 24 may protrude through the pan wall 12*a*, and the area around the external surface of the fluid couplers 22, 24 at the interface thereof with the pan wall 12*a* may be sealed to prevent and/or mitigate egress of oil from the oil pan 12 and/or ingress of contaminants into the interior of the oil pan 12. It is contemplated that for some embodiments, it may be necessary to modify the existing oil pan 12 to accommodate the additional volume therein occupied by the oil heat exchanger 10 without limitation unless otherwise indicated in the following claims. Such a modified oil pan 12 may have fluid couplers 22, 24 specifically integrated therewith such hat creating a seal between the external surface of the fluid couplers 22, 24 may be accomplished during manufacturing.

Pressurized heat transfer fluid may be supplied to one of the fluid couplers 22, 24, circulated through the fluid conduit 23, and exit the oil heat exchanger through the other fluid coupler 22, 24. The heat transfer fluid may either add thermal energy to the oil in contact with the oil heat exchanger 10 or extract thermal energy from the oil, depending at least on the relative temperatures of the oil, heat transfer fluid, and/or oil heat exchanger 10.

For example, in certain drag racing applications, it may be desirable to add thermal energy to the oil within the oil pan 12 so that the other components of the engine may remain as cool as possible just prior to the start of the race in order to maximize engine power output. In such an application it is contemplated that heated air (e.g., such as that provided via a typical air heating gun) may be introduced to one of the fluid couplers 22, 24 such that the heated air may add thermal energy to (heat) the fluid conduit 23 and exchange area 26, which in turn may add thermal energy to (heat) the oil within the oil pan 12. In such an application, the heat transfer fluid may be configured as air without limitation unless otherwise indicated in the following claims.

In another example, in certain circuit racing applications (e.g., oval track, road course, rally course, etc.), it may be desirable to remove thermal energy from the oil within the oil pan 12. As indicated above, in the prior art, such thermal transfer from the engine oil is typically accomplished with a discreet engine oil cooling system, which generally require dedicating piping, oil coolers (e.g., specific radiators dedicated to engine oil cooling), control systems, other fluid handling components, and/or other equipment, all of which add complexity and weight.

In an illustrative application of an oil heat exchanger 10, heat transfer fluid from the engine's cooling system may be supplied to one of the fluid couplers 22, 24 such that the heat transfer fluid may extract thermal energy from (cool) the fluid conduit 23 and exchange area 26, which in turn may extract thermal energy from (cool) the oil within the oil pan 12. In such an application, the heat transfer fluid may be configured as a liquid without limitation unless otherwise indicated in the following claims. Additionally, in any application of the oil heat exchanger 10 the fluid couplers 22, 24 and fluid conduit 23 may be configured to withstand a specific amount of internal pressure (which may be at least 24 psi without limitation unless otherwise indicated in the following claims) without leaking to ensure the heat transfer fluid does not leak from the oil heat exchanger 10 into the interior of the oil pan 12 without limitation unless otherwise indicated in the following claims.

The oil heat exchanger 10 may be configured with various control components (e.g., volumetric flow rate control valve, volumetric flow rate sensor, temperature sensor, etc.) such that the oil temperature remains as a specific value and/or within a specific temperature range without limitation unless otherwise indicated in the following claims.

Accordingly, in different illustrative applications of the oil heat exchanger 10, the oil heat exchanger 10 may serve to lower the oil temperature, maintain a desired oil temperature, or raise the oil temperature without limitation unless otherwise indicated in the following claims. The oil heat exchanger 10 may be used in any number of industries, including but not limited to drag racing, circuit or road racing, agricultural equipment, construction equipment, industrial equipment, and/or other industries without limitation unless otherwise indicated in the following claims. Any suitable heat transfer fluid may be used with the oil heat exchanger without limitation unless otherwise indicated in the following claims, and it is contemplated that for some illustrative applications liquid may be preferable and for other illustrative applications air may be preferable.

Although in the pictured illustrative embodiment of an oil heat exchanger 10 the exchange area 26 is configured as a flat plate, the scope of the present disclosure is not so limited unless otherwise indicated in the following claims. In another illustrative embodiment not pictured herein, the exchange area 26 may be configured to increase the surface area thereof available for contact with oil within the oil pan 12, which thereby may increase the rate of thermal energy transfer. Such an embodiment may have all or a portion of the exchange area 26 and/or fluid conduit 23 configured with various fins and/or other elements without limitation unless otherwise indicated in the following claims.

The various contours, shapes, dimensions, and/or general configuration of the oil heat exchanger 10 and/or components thereof may vary from one embodiment thereof to the next and are therefore in no way limiting to the scope of the pressure disclosure. Additionally, the specific shape of the fluid conduit 23 and/or exchange area 26 may vary from one embodiment of the oil heat exchanger 10 to the next, as may the specific mounting requirements of the oil heat exchanger 10, number, shape, and/or configuration of the mounting tab(s) 22, and/or engagement points between the oil heat exchanger 10 and the oil pan 12 and/or other structure. Accordingly, the scope of the present disclosure is in no way limited by the specific oil pan 12, engine configuration, equipment, and/or brand of engine for which the oil heat exchanger 10 is configured. That is, the rotary pump 80 extends to all types, brands, and/or uses of a rotary pump 80 wherein the application of the rotary pump 80 may benefit from one or more features disclosed herein.

The oil heat exchanger 10 and various elements thereof may be constructed of any suitable material known to those skilled in the art without limitation unless otherwise indicated in the following claims. In various embodiments as pictured herein, it is contemplated that most elements will be constructed of metal or metallic alloys (including but not limited to aluminum unless otherwise indicated in the following claims), polymers, or combinations thereof.

It should be noted that the oil heat exchanger 10 and components thereof are not limited to the specific embodiments pictured and described herein but is intended to apply to all similar apparatuses and methods for providing the various benefits of those elements unless so indicated in the following claims. Modifications and alterations from the described embodiments will occur to those skilled in the art without departure from the spirit and scope of the present disclosure.

Furthermore, variations and modifications of the foregoing are within the scope of the oil heat exchanger 10, and it is understood that the oil heat exchanger 10 as disclosed and defined herein extends to all alternative combinations of two or more of the individual features mentioned or evident from the text and/or drawings. All of these different combinations constitute various alternative aspects of the oil heat exchanger 10, and the embodiments described herein explain the best modes known for practicing the oil heat exchanger 10 and will enable others skilled in the art to utilize the same. The claims are to be construed to include alternative embodiments to the extent permitted by the prior art.

Having described preferred aspects of the various apparatuses, components thereof, and methods, other features of the present disclosure will undoubtedly occur to those versed in the art, as will numerous modifications and alterations in the embodiments and/or aspects as illustrated herein, all of which may be achieved without departing from the spirit and scope of the present disclosure. Accordingly, the methods and embodiments pictured and described herein are for illustrative purposes only, and the scope of the present disclosure extends to all apparatuses, components thereof, and/or methods for providing the various benefits and/or features of the present disclosure unless so indicated in the following claims.

While the various systems, methods, and components used therewith according to the present disclosure have been described in connection with preferred aspects and specific examples, it is not intended that the scope be limited to the particular embodiments and/or aspects set forth, as the embodiments and/or aspects herein are intended in all respects to be illustrative rather than restrictive. Accordingly, the processes and embodiments pictured and described herein are no way limiting to the scope of the present disclosure unless so stated in the following claims.

Although several figures are drawn to accurate scale, any dimensions provided herein are for illustrative purposes only and in no way limit the scope of the present disclosure unless so indicated in the following claims. It should be noted that the oil heat exchanger 10 and/or components thereof are not limited to the specific embodiments pictured and described herein, but rather the scope of the inventive features according to the present disclosure is defined by the claims herein. Modifications and alterations from the described embodiments will occur to those skilled in the art without departure from the spirit and scope of the present disclosure.

Any of the various features, components, functionalities, advantages, aspects, configurations, process steps, process parameters, etc. of an apparatus or method disclosed herein may be used alone or in combination with one another depending on the compatibility of the features, components, functionalities, advantages, aspects, configurations, process steps, process parameters, apparatuses, etc. Accordingly, a nearly infinite number of variations of the present disclosure exist. Modifications and/or substitutions of one feature, component, functionality, aspect, configuration, process step, process parameter, components, etc. for another in no way limit the scope of the present disclosure unless so indicated in the following claims.

It is understood that the present disclosure extends to all alternative combinations of one or more of the individual features mentioned, evident from the text and/or drawings, and/or inherently disclosed. All of these different combinations constitute various alternative aspects of the present disclosure and/or components thereof. The embodiments described herein explain the best modes known for practicing the apparatuses, methods, and/or components disclosed herein and will enable others skilled in the art to utilize the same. The claims are to be construed to include alternative embodiments to the extent permitted by the prior art.

Unless otherwise expressly stated in the claims, it is in no way intended that any process or method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

The invention claimed is:

1. A method of removing and adding thermal energy to a quantity of oil in a prior art internal combustion engine, of the type including but not limited to: an oil pan, oil, a cooling system, liquid coolant, a pump, said method comprising the steps of:

a. removing an oil pan from said internal combustion engine;

b. positioning a heat exchanger in said oil pan, wherein said heat exchanger comprises;

i. a body having a fluid conduit positioned internally thereto;

ii. a first fluid coupler fluidly connected to said fluid conduit;

iii. a second fluid coupler fluidly connected to said fluid conduit; and, iv. an exchange area connected to said fluid conduit;

c. connecting said first fluid coupler to said cooling system of said internal combustion engine, wherein said cooling system circulates said liquid coolant, and wherein said first fluid coupler acts as an inlet for said liquid coolant into said heat exchanger;

d. connecting said second fluid coupler to said cooling system of said internal combustion engine, wherein said second fluid coupler acts as an outlet for said liquid coolant into said heat exchanger;

e. replacing said oil pan on said internal combustion engine;

f. circulating said liquid coolant through said heat exchanger via a pump in said cooling system, wherein a temperature of said liquid coolant is less than a temperature of said quantity of oil, g. disconnecting said first fluid coupler from said cooling system;

h. disconnecting said second fluid coupler from said cooling system;

i. connecting said first fluid coupler to a heated fluid source, wherein said heated fluid source provides a pressurized heated fluid, and wherein said first fluid coupler acts as an inlet for said pressurized heated fluid into said heat exchanger;

j. allowing said pressurized heated fluid to exit said heat exchanger through said second fluid coupler;

k. wherein said pressurized heated fluid is a gas; and l. Modifying said oil pan such that said first fluid coupler and said second fluid coupler protrude from said oil pan.

2. The method according to claim 1 wherein said heat exchanger further comprises a tab, wherein said tab is configured to selectively engage said heat exchanger to an interior portion of said oil pan.

3. The method according to claim 1 wherein said step of replacing said oil pan is further defined as including a second oil pan, wherein said second oil pan is specifically configured for use with said heat exchanger.

4. A method of adding thermal energy to a quantity of oil in an internal combustion engine, said method comprising the steps of:

a. removing an oil pan from said internal combustion engine;

b. positioning a heat exchanger in said oil pan, wherein said heat exchanger comprises;

i. a body having a fluid conduit positioned internally thereto;

ii. a first fluid coupler fluidly connected to said fluid conduit;

iii. a second fluid coupler fluidly connected to said fluid conduit; and, iv. an exchange area connected to said fluid conduit;

c. connecting said first fluid coupler to a heated fluid source, wherein said heated fluid source provides a pressurized heated fluid, and wherein said first fluid coupler acts as an inlet for said pressurized heated fluid into said heat exchanger;

d. replacing said oil pan on said internal combustion engine;

e. circulating said pressurized heated fluid through said heat exchanger, wherein a temperature of said pressurized heated fluid is greater than a temperature of said quantity of oil, and at a pressure at least 24 pounds per square inch (PSI);

f. allowing said pressurized heated fluid to exit said heat exchanger through said second fluid coupler; modifying said oil pan such that said first fluid coupler and said second fluid coupler protrude from said oil pan;

g. wherein said pressurized heated fluid is a gas, wherein said gas is air heated by a heat gun and said heat exchanger further comprises a tab; and h. wherein said tab is configured to selectively engage said heat exchanger to an interior portion of said oil pam.

5. A method of removing thermal energy to a quantity of oil in an internal combustion engine, said method comprising the steps of:

a. removing an oil pan from said internal combustion engine;

b. positioning a heat exchanger in a replacement oil pan, wherein said heat exchanger comprises;

i. a body having a fluid conduit positioned internally thereto;

ii. a first fluid coupler fluidly connected to said fluid conduit;

iii. a second fluid coupler fluidly connected to said fluid conduit; and, iv. an exchange area connected to said fluid conduit;

c. connecting said first fluid coupler to a cooling system of said internal combustion engine, wherein said cooling system circulates a liquid coolant, wherein said first fluid coupler acts as an inlet for said liquid coolant into said heat exchanger, and wherein said first fluid coupler protrudes from said replacement oil pan;

d. connecting said second fluid coupler to said cooling system of said internal combustion engine, wherein said second fluid coupler acts as an outlet for said liquid coolant into said heat exchanger, and wherein said second fluid coupler protrudes from said replacement oil pan;

e. positioning said replacement oil pan on said internal combustion engine;

f. disconnecting said first fluid coupler from said cooling system;

g. disconnecting said second fluid coupler from said cooling system;

h. connecting said first fluid coupler to a heated fluid source, wherein said heated fluid source provides a pressurized heated gaseous fluid, and wherein said first fluid coupler acts as an inlet for said pressurized heated fluid into said heat exchanger;

i. allowing said pressurized heated gaseous fluid to exit said heat exchanger through said second fluid coupler and, j. circulating said liquid coolant through said heat exchanger via a pump in said cooling system, wherein a temperature of said liquid coolant is less than a temperature of said quantity of oil, and at a pressure at least 24 pounds per square inch (PSI).

6. The method according to claim 5 wherein said heat exchanger further comprises a tab, wherein said tab is configured to selectively engage said heat exchanger to an interior portion of said replacement oil pan.

7. The method according to claim 5 wherein said fluid conduit extends back and forth within said exchange area.

8. The method of claim 5 wherein said heated gaseous fluid is heated air generated by a heat gun.

* * * * *